United States Patent [19]

Boersma

[11] Patent Number: 4,655,913

[45] Date of Patent: Apr. 7, 1987

[54] ADJUSTABLE DRAIN COVER

[76] Inventor: Donald J. Boersma, 18610 John St., Country Club Hills, Ill. 60477

[21] Appl. No.: 725,914

[22] Filed: Apr. 22, 1985

[51] Int. Cl.[4] ..... B01D 35/02

[52] U.S. Cl. ..... 210/163; 52/20; 404/25

[58] Field of Search ..... 210/163, 164, 165, 166, 210/473, 474, 475, 477, 459; 52/20; 404/25; 4/268, 286; 285/42

[56] References Cited

U.S. PATENT DOCUMENTS

| | | | |
|---|---|---|---|
| 3,212,416 | 10/1965 | Boersma | 210/163 |
| 3,251,159 | 5/1966 | Trice | 52/20 |
| 3,390,224 | 6/1968 | Wyatt | 52/20 |
| 3,920,347 | 11/1975 | Sauriol et al. | 404/25 |
| 3,973,856 | 8/1976 | Gaglioti | 404/25 |
| 4,000,953 | 1/1977 | Langeliers et al. | 404/25 |
| 4,257,892 | 3/1981 | Boersma | 210/163 |
| 4,466,219 | 8/1984 | Campolito | 404/25 |

FOREIGN PATENT DOCUMENTS

| | | | |
|---|---|---|---|
| 2096213 | 10/1982 | European Pat. Off. | 52/20 |

*Primary Examiner*—Richard V. Fisher
*Assistant Examiner*—Wanda L. Millard
*Attorney, Agent, or Firm*—David D. Kaufman

[57] ABSTRACT

A drain cover having separable mounting means which is adjustable for operational installation in drain pipes of varying standard sizes. The mounting means comprise resilient fingers having short feet which are releasably engageable in radially spaced stirrups die punched from the drain cover disc. In another preferred embodiment, the drainage openings comprise elongated slots having roll formed tubular sockets depending therefrom and the resilient fingers have pairs of wire feet which are frictionally engageable in said sockets.

16 Claims, 6 Drawing Figures

ADJUSTABLE DRAIN COVER

TECHNICAL FIELD

This invention relates to floor drain covers and, more particularly, to an improved drain cover having adjustable attachment means enabling the cover to be operationally retained in drain pipes of varying sizes.

BACKGROUND OF THE INVENTION

Many of the problems associated with the installation and use of floor drain covers are described in my prior U.S. Pat. No. 3,212,416. That structure comprised a unitary plate or disc having a plurality of depending resilient fingers struck therefrom. The fingers cooperated with the drain pipe to frictionally retain the cover in operational position wherein the disc overlaid the surrounding floor surface so that fine finishing of the floor or pipe was not required.

Another of my prior patents is U.S. Pat. No. 4,257,892 which teaches a drain cover having adjustable slugs and camming means for moving the slugs into locking engagement with an associated drain pipe. Those adjustable locking means were thus able to compensate for shape irregularities or minor variations in dimension of the drain pipe.

It is, of course, well known that drain pipes, sewer pipes, and the like, are made in a variety of diameters. The known prior art drain covers, including those shown in my said patents, were capable of installation and operation only in a pipe of a given size. Thus, for example, the prior art drain covers were required to be made and stocked in a number of sizes, such as, 2 inch, 3 inch, or 5 inch, diameter, in order to be usable with drain pipes of those dimensions.

The necessity of making and stocking the drain covers in a number of sizes obviously added to the cost of the device. In addition, considerable inconvenience could be encountered if a particular needed size was in short supply or out of stock. There thus exists a need for a drain cover which is universal and usable with the full spectrum of standard drain pipe sizes.

SUMMARY OF THE INVENTION

The present invention provides a floor drain cover which is universal in that it is adjustable and usable with standard drain pipes of all sizes, such as, in a range of from to 2 inches to 6 inches diameter.

The drain cover of the invention comprises a plate or disc of sufficient size to overlie the floor surrounding the largest contemplated drain, for example, pipe of 6 inch diameter. A plurality of removable resilient legs are associated with the disc. The disc is provided with means for attaching the legs thereto at varying diametric distances from the center so that the legs may be readily attached to provide the desired inner pipe diameter.

In a preferred embodiment, the attachment means comprises die-punched slots and stirrups depending from the bottom surface of the disc. Each radial row of slots may be spaced at increments of one-half inch so that the attached legs will define the standard diameters of 2, 3, 4, 5 and 6 inches.

In another preferred embodiment, the disc is formed with a drainage pattern of elongated slots rather than holes. On its underside, the disc is roll formed to provide series of spaced rolled sockets into which the feet of the resilient legs may be inserted and frictionally retained.

Other features and advantages of the invention will be apparent from the following description and claims and are illustrated in the accompanying drawings which show structures embodying the preferred features of the present invention and the principles thereof.

BRIEF DESCRIPTION OF THE DRAWINGS

In the accompanying drawings forming a part of the specification, and in which like numerals are employed to designate like parts of the same.

DETAILED DESCRIPTION OF THE INVENTION

Figure 1:
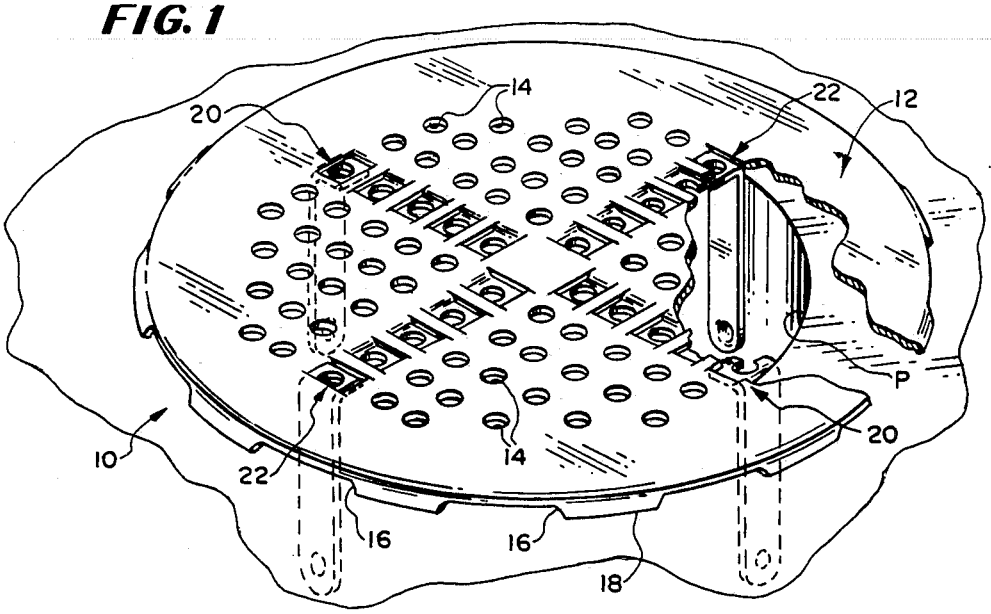
FIG. 1 is a perspective view of a drain cover embodying the principles of the invention, with portions broken away, and showing the same operationally installed in a drain pipe.

Referring with greater particularity to FIGS. 1 to 4 of the drawings, it will be seen that the reference numeral 10 indicates generally a drain cover embodying the principles of the invention. The drain cover 10 comprises a circular plate or disc 12 having a plurality of drainage openings such as the circular holes 14 formed therein. Disc 12 may be slightly convex in form and is provided with a plurality of weep holes 16 along its marginal edge 18.

Drainage holes 14 may be formed in any desired shape and pattern, but in the preferred embodiment the holes lie along and define at least four opposed and equally spaced radii 20, 20 and 22, 22 of the circular disc 12. Along said radii 20 and 22, the drainage holes 14 preferrably are spaced at regular intervals, such as one-half inch, for reasons which will become apparent as the description proceeds.

Disc 12 comprises further integral connector means lying along said radii 20 and 22. The said connector means comprises a plurality of integral connector straps or stirrups 24 die punched from the disc 12 so that the same depend from the bottom surface 26 of the disc (see FIGS. 2–4). As indicated in the drawings, each of the stirrups 24 has one of the drainage openings 14 formed therein.

Separable drain cover attachment means are associated with the disc 12, said attachment means comprising a plurality of resilient fingers 30. Each of the fingers 30 comprises an elongated leg 32 having a short foot 34 bent at a substantially right angle thereto. The free end of the leg 32 may be formed with an outwardly extending gripper projection 35. A nipple or protuberance 36 is provided in the leg 34 adjacent the free end thereof and said nipple is adapted to be frictionally snap fit into a stirrup 24. The foot 34 also includes a hole 38 formed therein.

Figure 2:
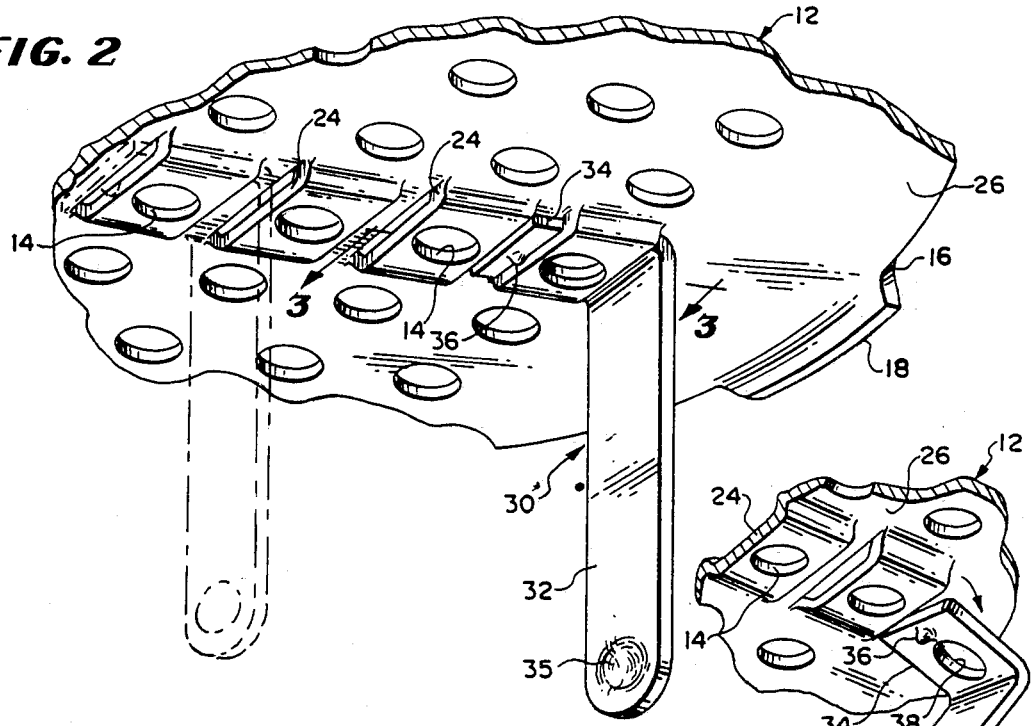
FIG. 2 is an enlarged, bottom perspective view of a fragment of the drain cover.
Figure 3:
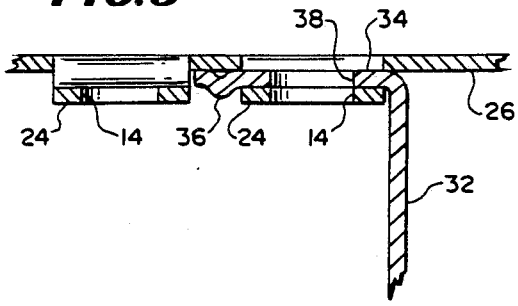
FIG. 3 is a sectional view taken on the plane of line 3—3 in FIG. 2.
Figure 4:
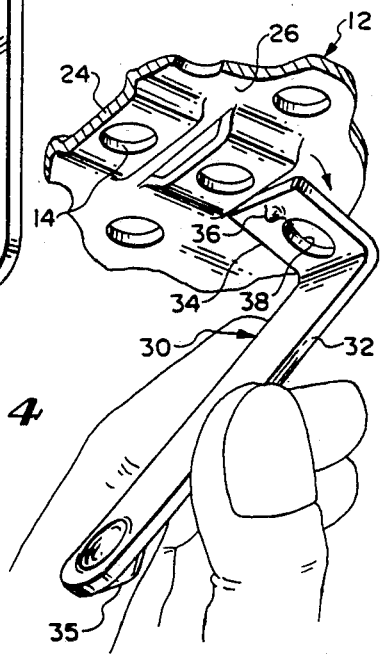
FIG. 4 is a fragmentary perspective view illustrating the manner of attaching or disconnecting one of the legs from the drain cover.

To operationally connect a finger 30 to any selected stirrup 24, the foot 34 is frictionally forced through the stirrup until the nipple 36 passes completely therethrough. In this condition, as illustrated in FIGS. 2 and 3, the finger 30 is securely locked in place because the nipple prevents inadvertent removal from the stirrup while the leg 32 prevents further inward movement of the finger toward the center of the disc 12. It will also be noted that the hole 38 and drainage opening 14 are then in operational alignment so that there is no diminution of the drainage capability of the cover 10. To remove the finger 30 from the stirrup 24 to which it is connected, it is simply necessary to reverse the procedure, as illustrated in FIG. 4 of the drawings.

It will be appreciated that the spaced stirrups 24 positioned along the radii 20 and 22 permit selective positioning of the fingers 30 to accommodate the particular drain pipe into which the drain cover is to be installed. In the embodiment illustrated, the stirrups 24 are spaced at one-half inch intervals so that the cover 10 is suitable for installation in drain pipes of 2, 3, 4, 5 and 6 inch diameter. In FIG. 1, the drain pipe P has a 6 inch diameter and the fingers 30 are connected in the outermost stirrups to define a circle of that diameter. To operationally install the cover 10 in the pipe P, the fingers 30 are pressed down into the pipe until the disc 12 bears against the floor F whereupon the resilient fingers and their gripper projections 35 cooperate with the pipe for a snug frictional engagement.

Figure 5:
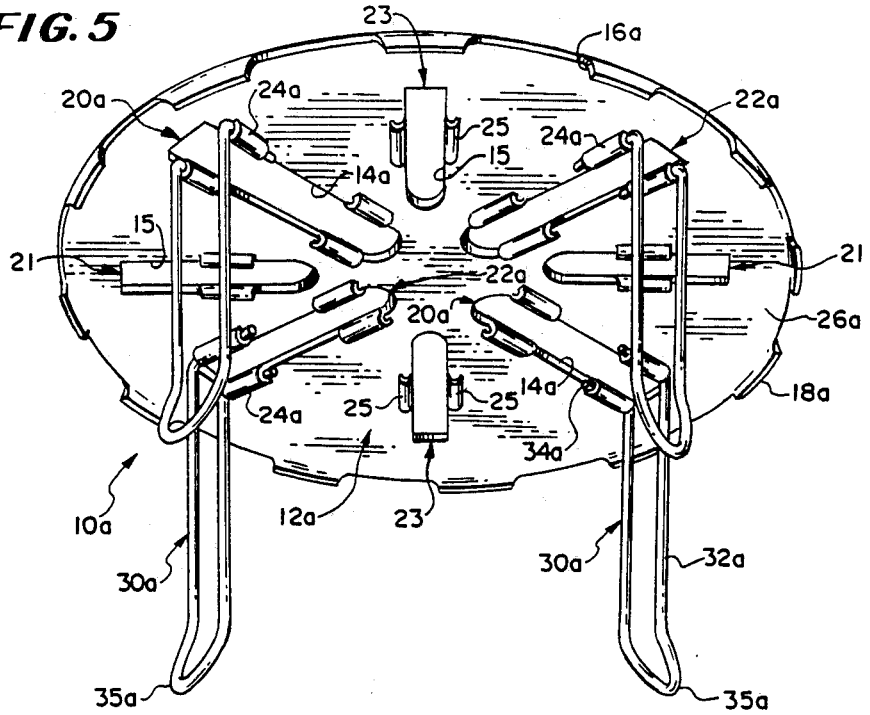
FIG. 5 is a bottom perspective view of a modified form of the drain cover.
Figure 6:
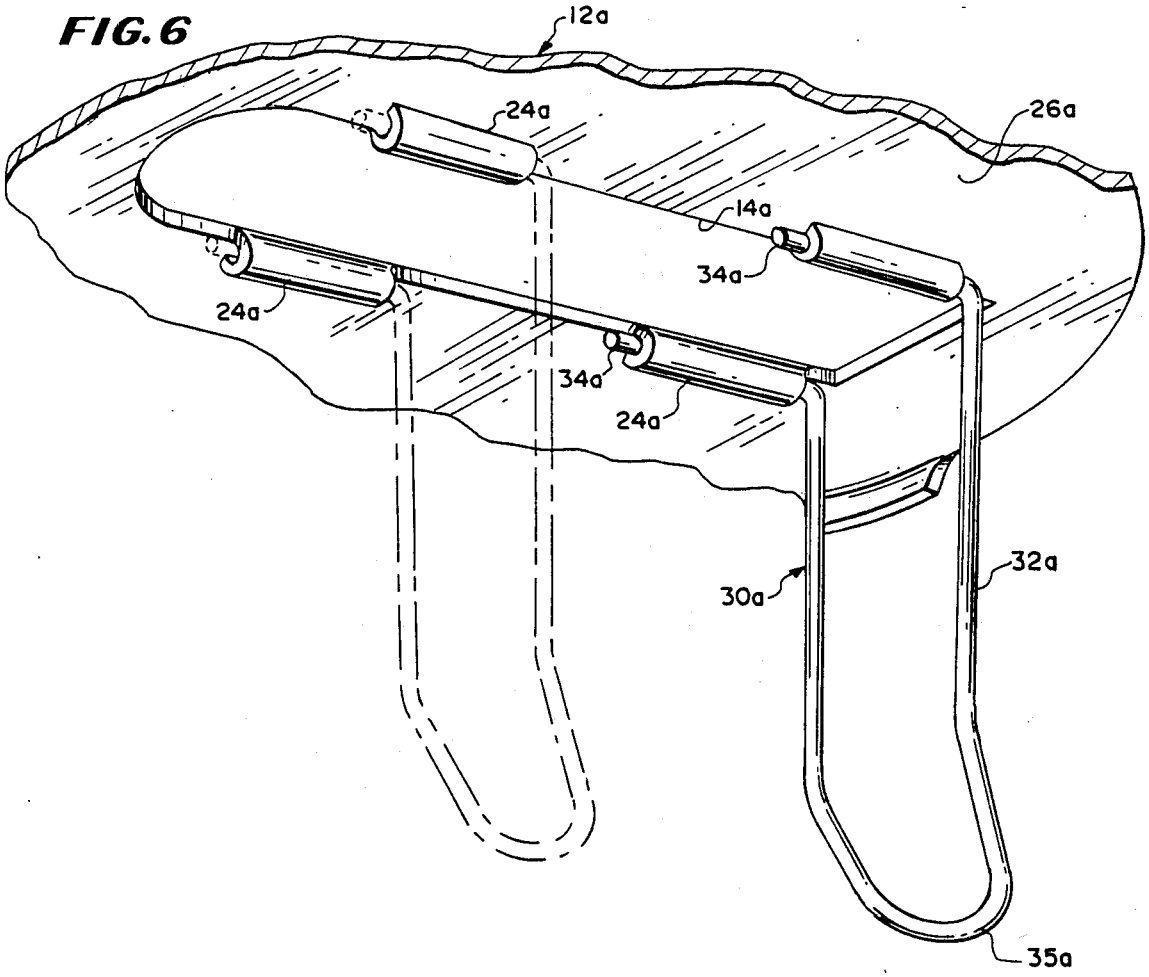
FIG. 6 is an enlarged, bottom perspective view of a fragment of the drain cover of FIG. 5.

A modified form of the invention is illustrated in FIGS. 5 and 6 of the drawings wherein similar parts are identified with similar reference numerals with the suffix "a" added. It will thus be seen that the drain cover **10*a* comprises a circular disc 12*a* having weep holes 16*a* provided in the marginal edge 18*a* thereof. The disc 12*a* is provided with four opposed, elongated drainage slots 14*a* which lie along and define radii 20*a*, 20*a* and 22*a*, 22*a* of the circular disc 12*a*. Disc 12*a* is provided additionally with four opposed, shorter drainage slots 15 lying along and defining radii 21, 21 and 23, 23**.

Drainage slots **14*a* have opposed pairs of tubular connector sockets 24*a* depending from the marginal edges thereof. The sockets 24*a* may be made by conventional roll forming techniques and, in the embodiment illustrated, the pairs are spaced radially apart by one inch. Drainage slots 15 are formed with a single pair of tubular sockets 25, but positioned radially between the pairs of sockets 24*a***.

Resilient fingers **30*a* comprise integral return-bent members made of metallic wire or other suitable materials and having an elongated leg 32*a*, short feet 34*a*, 34*a*, and an outwardly bent gripper projection 35*a*. The feet 34*a* are adapted to be frictionally received in any pair of sockets 24*a* or 25. In the embodiment illustrated, the sockets are spaced so that when the fingers 30*a* are connected to the innermost ring of sockets 24*a* they define a circle of 3 inch diameter; when connected to the sockets 25 they define a circle of 4 inch diameter; and when connected to the outermost sockets 24*a* they define a circle of 5 inch diameter. Other spacing and arrangements of the sockets 24*a* and/or 25 could likewise be provided so that the cover 10*a*** is suitable for use with drain pipes of all standard sizes.

Operation of the drain cover **10*a* is, of course, substantially identical with that of the drain cover 10, with the feet 34*a* being frictionally engageable with the sockets 24*a* or 25** to provide a secure operational connection, and being equally readily disengageable from said sockets when adjustment or change to a different diameter drain pipe use is desired.

While preferred embodiments of the invention have been illustrated and described herein, it will be appreciated that changes and variations may be made by those skilled in the art without departing from the spirit and scope of the appended claims. The invention is defined by the claims that follow.

What is claimed is:

1. A drain cover comprising:

a disc having drainage openings formed therein;

a plurality of separable mounting means associated with the disc for operationally mounting the drain cover on a drain pipe; and connector means on said disc for releasably connecting said mounting means to said disc, said connector means being arranged to provide adjustable selective positioning of said mounting means whereby said drain cover is operationally installable on drain pipes of varying diameters.

2. A drain cover according to claim 1 wherein said disc is circular in configuration and said connecter means lie on radii of said disc.

3. A drain cover according to claim 2 wherein said connector means are integrally formed with said disc and depend from the bottom surface thereof.

4. A drain cover according to claim 3 wherein said mounting means comprises a plurality of resilient fingers, each of said fingers being releasably engageable with any of said connector means.

5. A drain cover according to claim 4 wherein said connector means are arranged in regularly spaced relationship along said radii whereby said fingers are selectively engageable in said connector means to define circles of a plurality of diameters.

6. A drain cover according to claim 5 wherein said connector means comprises a plurality of stirrups die punched from said disc and integral therewith.

7. A drain cover according to claim 6 wherein each of said fingers comprises an elongated leg and an integral foot substantially perpendicular thereto, said foot being frictionally engageable in any of said stirrups.

8. A drain cover according to claim 7 wherein said foot comprises an integral protuberance adjacent the free end thereof, said protuberance being releasably snap-fittable into said stirrup and cooperating with the stirrup to prevent inadvertent removal of said leg therefrom.

9. A drain cover according to claim 5 wherein said drainage openings comprise a plurality of slots lying on radii of said disc and said connector means comprises a plurality of opposed pairs of tubular sockets integrally depending from the marginal edges of said slots.

10. A drain cover according to claim 9 wherein each of said fingers comprises a bent wire member having an elongated leg and a pair of feet substantially perpendicular to said leg, said feet being frictionally engageable in any of said pairs of sockets.

11. A drain cover comprising:

a circular disc having a plurality of drainage openings formed therein;

a plurality of separable resilient mounting fingers associated with said disc for operationally mounting the drain cover on a drain pipe; and a plurality of spaced connector means integrally depending from said disc, said connector means being arranged on opposed radii of said circular disc whereby said fingers are selectively engageable with said connector means to define circles of varying diameters whereby said drain cover is operationally installable on drain pipes of varying inner diameters.

12. A drain cover according to claim 11 wherein said connector means are arranged in regularly spaced relationship on at least four of said radii of said disc.

13. A drain cover according to claim 12 wherein said connector means comprises a plurality of stirrups punched from said disc and said fingers comprise short feet frictionally engageable in said stirrups.

14. A drain cover according to claim 12 wherein said drainage openings comprise four elongated slots lying on radii of said disc and said connector means comprises opposed pairs of tubular sockets depending from the marginal edges of said slots.

15. A drain cover according to claim 14 wherein said drainage openings comprise further four shorter slots lying on other radii of said disc and said connector means comprises pairs of tubular sockets depending from the marginal edges of said shorter slots.

16. A drain cover according to claim 15 wherein each of said fingers comprises an integral return-bent member having an elongated leg and a pair of short feet substantially perpendicular thereto, said feet being frictionally engageable in said sockets.

* * * * *